US011328648B2

(12) United States Patent
Zhang et al.

(10) Patent No.: US 11,328,648 B2
(45) Date of Patent: May 10, 2022

(54) DISPLAY PANEL AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Duo Zhang, Beijing (CN); Yinghao Zhang, Beijing (CN); Feng Jiang, Beijing (CN); Yongquan Lu, Beijing (CN); Weimeng Zhang, Beijing (CN); Xuru Zhang, Beijing (CN); Yanjie Zhang, Beijing (CN); Qian Wang, Beijing (CN)

(73) Assignees: Beijing BOE Display Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/270,067

(22) PCT Filed: May 14, 2020

(86) PCT No.: PCT/CN2020/090199

§ 371 (c)(1),
(2) Date: Feb. 22, 2021

(87) PCT Pub. No.: WO2020/233490

PCT Pub. Date: Nov. 26, 2020

(65) Prior Publication Data

US 2021/0304655 A1 Sep. 30, 2021

(30) Foreign Application Priority Data

May 17, 2019 (CN) ..... 201910412211.9

(51) Int. Cl.
*G09G 3/20* (2006.01)

(52) U.S. Cl.
CPC ..... *G09G 3/2003* (2013.01); *G09G 3/2074* (2013.01); *G09G 2300/0452* (2013.01); *G09G 2310/027* (2013.01)

(58) Field of Classification Search
CPC ..... G09G 3/2003; G09G 3/2074; G09G 2300/0452; G09G 2310/027
See application file for complete search history.

(56) References Cited

U.S. PATENT DOCUMENTS 6,266,038 B1 7/2001 Yoshida et al.
7,589,703 B2 9/2009 Su et al.
(Continued)

FOREIGN PATENT DOCUMENTS

CN 1540606 A 10/2004
CN 101017303 A 8/2007
(Continued)

OTHER PUBLICATIONS

First office action issued in Chinese Patent Application No. 201910412211.9 with search report.
(Continued)

*Primary Examiner* — Ricardo Osorio
(74) *Attorney, Agent, or Firm* — Chiwin Law LLC

(57) ABSTRACT

A display panel is disclosed, including a plurality of data lines, a plurality of groups of gate lines and a plurality of pixel units. Each group of gate lines includes at least three gate lines. The pixel units are arranged in an array, each pixel unit includes a plurality of subpixels, and each subpixel includes at least two sub-subpixels. Each row of subpixels is configured to be controlled by a corresponding group of gate lines, and each column of subpixels is configured such that the at least two sub-subpixels receive a data signal from a
(Continued)

corresponding data line under a control of each group of gate lines. A display device including the display panel is also disclosed.

17 Claims, 4 Drawing Sheets

(56) References Cited

U.S. PATENT DOCUMENTS 9,454,938 B2 9/2016 Jung et al.
9,606,381 B2 * 3/2017 Yamaguchi ..... G02F 1/133512
9,671,662 B2 * 6/2017 Hsu ..... G02F 1/136286
9,784,997 B2 * 10/2017 Li ..... G02F 1/134309
9,818,355 B2 * 11/2017 Xu ..... G02F 1/13624
10,297,654 B2 * 5/2019 Motoyama ..... H01L 27/3272
10,527,902 B2 1/2020 Umezaki et al.
10,600,350 B2 3/2020 Chu Ke
10,665,640 B2 * 5/2020 Zhu ..... H01L 27/3216
2005/0093799 A1 5/2005 Lo et al.
2005/0243047 A1 * 11/2005 Asao ..... G09G 3/3651 345/88
2006/0087478 A1 * 4/2006 Eom ..... G09G 3/3266 345/45
2007/0241989 A1 * 10/2007 Kim ..... G09G 3/3648 345/3.1
2008/0279498 A1 * 11/2008 Sampsell ..... G02B 26/001 385/8
2009/0121992 A1 * 5/2009 Asao ..... G02F 1/1393 345/88
2009/0141202 A1 6/2009 Yoshida et al.
2009/0295703 A1 12/2009 Hsieh et al.
2009/0309821 A1 * 12/2009 Tanno ..... H01L 27/326 345/87
2010/0053043 A1 * 3/2010 Sakamoto ..... H01L 27/3213 345/77
2010/0053052 A1 * 3/2010 Shimoshikiryoh .. G09G 3/3607 345/89
2010/0134524 A1 6/2010 Hayashi et al.
2011/0170031 A1 7/2011 Son et al.
2012/0268357 A1 * 10/2012 Shih ..... G09G 3/3648 345/88
2012/0293763 A1 * 11/2012 Inoue ..... G03F 1/50 349/178
2013/0120469 A1 5/2013 Tien et al.
2013/0229326 A1 9/2013 Kamada
2014/0111410 A1 4/2014 Guo
2014/0118669 A1 * 5/2014 Zhao ..... G02F 1/133516 349/106
2014/0293189 A1 * 10/2014 Fukunaga ..... G02F 1/133606 349/65
2015/0293401 A1 * 10/2015 Yi ..... G02B 5/201 359/891
2016/0372043 A1 * 12/2016 Yamanaka ..... G09G 3/3266
2017/0061853 A1 * 3/2017 Yang ..... G09G 3/22
2017/0169753 A1 6/2017 Hao et al.
2017/0330510 A1 11/2017 Huang et al.
2018/0261171 A1 9/2018 Morein
2020/0135829 A1 * 4/2020 Kim ..... H01L 27/3265
2021/0020126 A1 * 1/2021 Lin ..... G09G 3/3607
2021/0175179 A1 * 6/2021 Liu ..... H01L 23/544
2021/0286224 A1 * 9/2021 Chen ..... G02F 1/13624

FOREIGN PATENT DOCUMENTS

CN 101154342 A 4/2008
CN 101681602 A 3/2010
CN 202075968 U 12/2011
CN 102799036 A 11/2012
CN 103472644 A 12/2013
CN 104267527 A 1/2015
CN 104424880 A 3/2015
CN 104991362 A 10/2015
CN 105467704 A 4/2016
CN 106205513 A 12/2016
CN 106249496 A 12/2016
CN 107255894 A 10/2017
CN 107621716 A 1/2018
CN 108573672 A 1/2018
CN 108732812 A 2/2018
CN 107680550 A 9/2018
CN 108828850 A 11/2018
CN 109308884 A 2/2019
CN 109545137 A 3/2019
CN 110136625 A 8/2019
JP 11143433 A 5/1999
JP 2001109018 A 4/2001
JP 2013054366 A 3/2013
WO 2012063830 A1 5/2012

OTHER PUBLICATIONS

Third Office Action issued in Chinese Patent Application No. 201910412211.9 with search report.

* cited by examiner

DISPLAY PANEL AND DISPLAY DEVICE

This application is a U.S. National Phase Entry of International Application No. PCT/CN2020/090199 filed on May 14, 2020, designating the United States of America and claiming priority to Chinese Patent Application No. 201910412211.9, filed on May 17, 2019. The present application claims priority to and the benefit of the above-identified applications and the above-identified applications are incorporated by reference herein in their entirety.

TECHNICAL FIELD

Embodiments of the present disclosure relate to a display panel and a display device including the same.

BACKGROUND

Wearable devices such as smart watches have been gradually favored by consumers. By using transflective technology, smart wearable devices can realize reflection under strong light and realize transmission under dark light. This reduces the power consumption of the device and improves the battery life. In addition, the working mode of reflection under strong light improves the moderation of wearable devices under strong light, thus improving the experience of consumers.

SUMMARY

In one aspect, an embodiment of the present disclosure provides a display panel including: a plurality of data lines; a plurality of groups of gate lines, wherein each of the plurality of groups of gate lines includes at least three gate lines; and a plurality of pixel units, wherein the plurality of pixel units are arranged in an array, each of the plurality of pixel units includes a plurality of subpixels, and each of the plurality of subpixels includes at least two sub-subpixels, wherein each row of subpixels is configured to be controlled by a corresponding group of gate lines, and each column of subpixels is configured such that the at least two sub-subpixels receive a data signal from a corresponding data line under a control of each of the plurality of groups of gate lines.

In one or more embodiments, two groups of gate lines corresponding to two adjacent rows of subpixels share one gate line.

In one or more embodiments, the plurality of groups of gate lines include odd-numbered groups of gate lines corresponding to odd-numbered rows of pixel units and even-numbered groups of gate lines corresponding to even-numbered rows of pixel units, and wherein two adjacent odd-numbered gate lines share one gate line, and two adjacent even-numbered gate lines share one gate line.

In one or more embodiments, for each of the plurality of subpixels, the display panel further includes a plurality of switching elements, and an on-off of each of the plurality of switching elements is controlled by a corresponding gate line.

In one or more embodiments, in each of the plurality of subpixels, each of the at least two sub-subpixels is connected to a corresponding data line through two switching elements of the plurality of switching elements.

In one or more embodiments, each of the plurality of subpixels includes a first sub-subpixel and a second sub-subpixel; each of the plurality of groups of gate lines includes a first gate line, a second gate line and a third gate line; and the plurality of switching elements include a first switching element, a second switching element and a third switching element.

In one or more embodiments, the first gate line controls an on-off of the first switching element, the second gate line controls an on-off of the second switching element, and the third gate line controls an on-off of the third switching element.

In one or more embodiments, for each of the plurality of subpixels, the first sub-subpixel is connected to the first data line through the first switching element and the second switching element, and the second sub-subpixel is connected to the first data line through the third switching element and the second switching element.

In one or more embodiments, a ratio of an area of the first sub-subpixel to an area of the second sub-subpixel is 2:1.

In one or more embodiments, each of the plurality of subpixels includes a first sub-subpixel, a second sub-subpixel and a third sub-subpixel; each of the plurality of groups of gate lines includes a first gate line, a second gate line and a third gate line; and the plurality of switching elements include a first switching element, a second switching element, a third switching element, a fourth switching element and a fifth switching element.

In one or more embodiments, the first gate line controls an on-off of the first switching element and the fourth switching element, the second gate line controls an on-off of the second switching element, and the third gate line controls an on-off of the third switching element and the fifth switching element.

In one or more embodiments, for each of the plurality of subpixels, the first sub-subpixel is connected to the first data line through the first switching element and the second switching element, the second sub-subpixel is connected to the first data line through the fifth switching element and the fourth switching element, and the third sub-subpixel is connected to the first data line through the third switching element and the second switching element.

In one or more embodiments, a ratio of an area of the first sub-subpixel to an area of the second sub-subpixel to an area of the third sub-subpixel is 4:2:1.

In one or more embodiments, the first sub-subpixel, the second sub-subpixel and the third sub-subpixel of each of the plurality of subpixels have a same primary color.

In one or more embodiments, the third sub-subpixel of each of the plurality of subpixels is a white sub-subpixel.

In one or more embodiments, the white sub-subpixel is a total reflection sub-subpixel.

In one or more embodiments, the switching element is a thin film transistor.

On the other hand, the embodiment of the present disclosure also provides a display device, including the display panel as described above.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure. In the drawings.

The drawings are only schematic and are not necessarily drawn to scale. Throughout the drawings, the same reference numerals indicate the same or similar parts.

DETAILED DESCRIPTION

In order to make objects, technical details and advantages of the embodiments of the invention apparent, technical solutions according to the embodiments of the present invention will be described clearly and completely as below in conjunction with the accompanying drawings of embodiments of the present invention. It is to be understood that the described embodiments are only a part of but not all of exemplary embodiments of the present invention. Based on the described embodiments of the present invention, various other embodiments can be obtained by those of ordinary skill in the art without creative labor and those embodiments shall fall into the protection scope of the present invention.

Unless otherwise defined, all the technical and scientific terms used herein have the same meanings as commonly understood by one of ordinary skill in the art to which the present invention belongs. The terms, such as "first," "second," or the like, which are used in the description and the claims of the present application, are not intended to indicate any sequence, amount or importance, but for distinguishing various components. Also, the terms, such as "a/an," "one," or the like, are not intended to limit the amount, but for indicating the existence of at lease one. The terms, such as "comprise/comprising," "include/including," or the like are intended to specify that the elements or the objects stated before these terms encompass the elements or the objects and equivalents thereof listed after these terms, but not preclude other elements or objects. The terms, such as "connect/connecting/connected," "couple/coupling/coupled" or the like, are not intended to define a physical connection or mechanical connection, but may include an electrical connection/coupling, directly or indirectly. The terms, "on," "under," "left," "right," or the like are only used to indicate relative position relationship, and when the position of the object which is described is changed, the relative position relationship may be changed accordingly.

Due to the limitation of size and power consumption, the Driver IC of wearable devices can only use Serial Peripheral Interface (SPI) signals for transmission. This kind of signal is high level or low level, that is, 0 or 1, so it is impossible to realize different display gray levels by directly controlling the level of the control signal in the data line.

Figure 1:
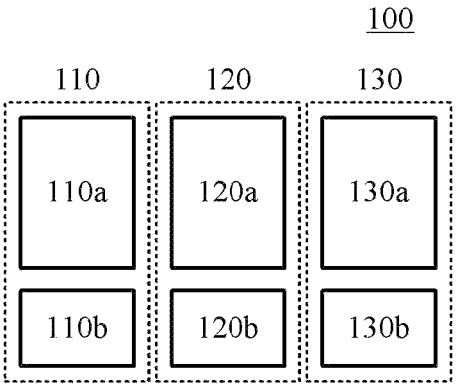
FIG. 1 is a schematic diagram of a pixel unit of a display panel according to an embodiment of the present disclosure.

As a solution, an embodiment of the present disclosure provides a display panel, in which a subpixel in a pixel unit is divided into two sub-subpixels, and the sub-subpixels are respectively turned on or turned off to realize different display gray scales. FIG. 1 schematically shows the layout of pixel units of a display panel adopting this solution. As shown in FIG. 1, the display panel may include a plurality of pixel units 100 (only one of these pixel units is shown by way of example in FIG. 1). Each pixel unit 100 may include three subpixels, for example, a first subpixel 110, a second subpixel 120, and a third subpixel 130. Taking the RBG tricolor display system as an example, the first subpixel 110 is a red subpixel, the second subpixel 120 is a green subpixel, and the third subpixel 130 is a blue subpixel. In the layout of FIG. 1, each subpixel is divided into two sub-subpixels. The first subpixel 110 includes a first sub-subpixel 110*a* and a second sub-subpixel 110*b*, the second subpixel 120 includes a first sub-subpixel 120*a* and a second sub-subpixel 120*b*, and the third subpixel 130 includes a first sub-subpixel 130*a* and a second sub-subpixel 130*b*. The two sub-subpixels of each subpixel are divided according to the preset area ratio. Generally, the area ratio of the first sub-subpixel to the second sub-subpixel is 2:1. Taking the first subpixel 110 as an example, the area ratio of the first sub-subpixel 110*a* to the second sub-subpixel 110*b* is 2:1.

Figure 2:
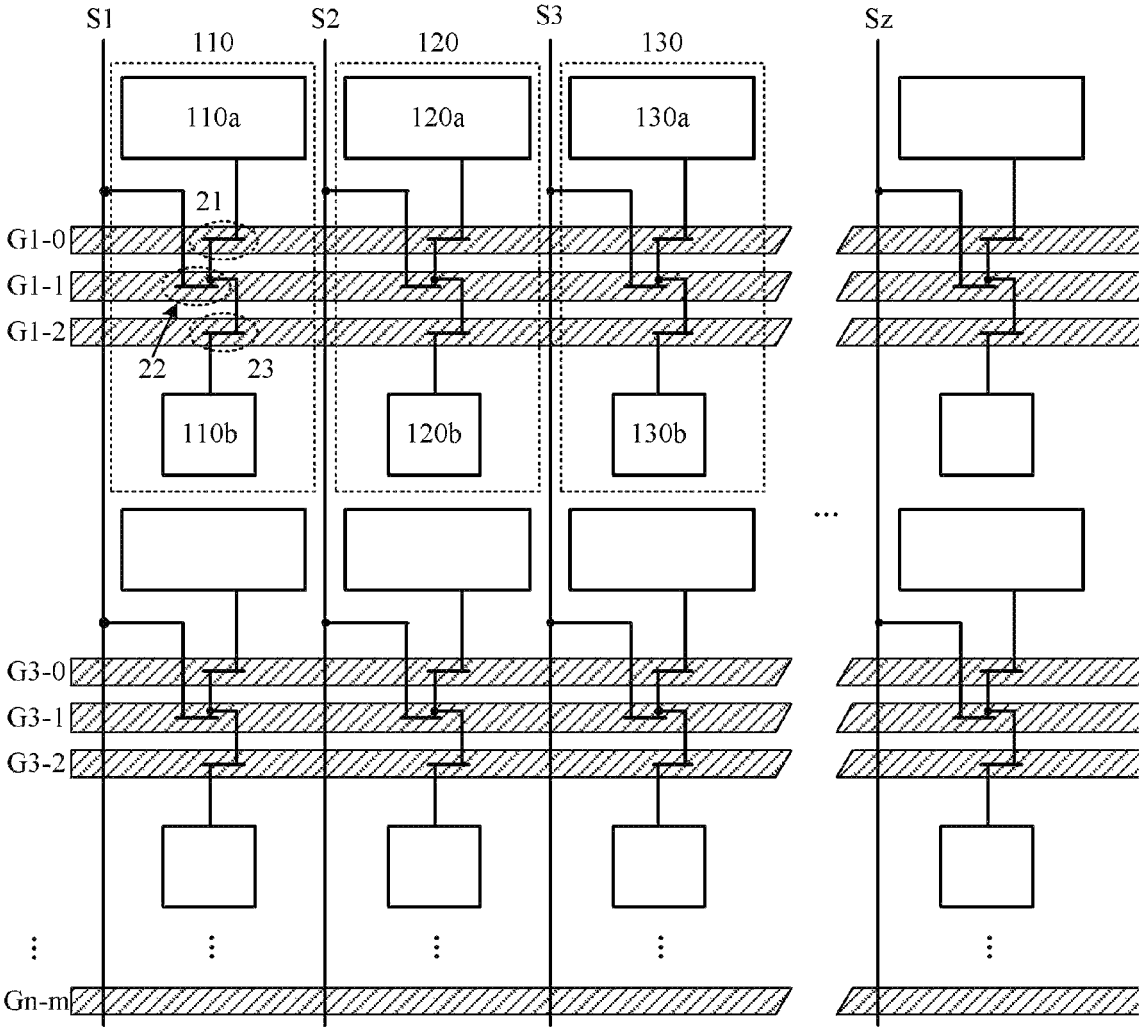
FIG. 2 is a wiring diagram for the pixel unit shown in FIG. 1.

FIG. 2 schematically shows a wiring diagram for the pixel unit shown in FIG. 1. As shown in FIG. 2, a plurality of pixel units 100 are arranged in an array. The display panel also includes a plurality of data lines and a plurality of gate lines which are arranged in a staggered manner. FIG. 2 shows only a few rows of pixel units, z data lines S1, S2, S3 . . . Sz, and odd numbers of gate lines G1-0, G1-1, G1-2, G3-0, G3-1, G3-2 . . . Gn-m. Here, n is a positive odd number greater than 1, and m is an integer between 0 and 2.

As shown in FIG. 2, each row of subpixels corresponds to a group of gate lines, and each group of gate lines includes three gate lines. The pixel units 100 in the first odd-numbered row correspond to the first group of gate lines. The first group of gate lines includes a first gate line G1-0, a second gate line G1-1 and a third gate line G1-2. The pixel units 100 in the second odd-numbered row correspond to the third group of gate lines. The third group of gate lines includes a third gate line G3-0, a fourth gate line G3-1 and a fifth gate line G3-2. Pixel units in even-numbered rows and their corresponding groups of gate lines are not shown here, for example, pixel units in the first even-numbered row and their corresponding second group of gate lines, and pixel units in the second even-numbered row and their corresponding fourth group of gate lines are not shown here. Two adjacent odd-numbered groups of gate lines can share one gate line, and two adjacent even-numbered groups of gate lines can share one gate line. For example, G1-2 and G3-0 can be the same gate line, and G4-0 and G2-2 can be the same gate line.

In this embodiment, each of the three subpixels is turned on or off to provide different display gray scales. Taking the first subpixel 110 as an example, the first sub-subpixel 110*a* is connected to the data line S1 through the first switching element 21 and the second switching element 22, wherein the first gate line G1-0 controls the on-off of the first switching element 21, and the second gate line G1-1 controls the on-off of the second switching element 22; the second sub-subpixel 110*b* is connected to the data line S1 through the third switching element 23 and the second switching element 22, wherein the third gate line G1-2 controls on-off of the third switching element 23, and the second gate line G1-1 controls on-off of the second switching element 22. That is, one sub-subpixel is controlled by two switching elements jointly. The first sub-subpixel 110*a* is controlled by a combination of the first switching element 21 and the second switching element 22, and the second sub-subpixel 110*b* is controlled by a combination of the second switching element 22 and the third switching element 23. The data lines S1-Sz are configured to provide electrical signals, such as voltage signals, that drive the sub-subpixels to emit light. The gate lines G1-0 to Gn-m are configured to control the sub-subpixels of each row of subpixels according to a certain timing, for example, to turn on or off the corresponding sub-subpixels. For example, when the gate lines G1-0 and G1-1 are both at high level (i.e., both are "1"), the first data line S1 and the first sub-subpixel 110*a* are conducted there-between, so that the first sub-subpixel 110*a* is turned on. When the gate lines G1-1 and G1-2 are at high level at the same time, the first data line S1 and the second sub-subpixel 110*b* are conducted there-between, so that the second sub-subpixel 110*b* is turned on. Every adjacent three gate lines are considered as one group, and the gate lines are scanned group by group to realize the display of the whole display panel. For example, the gate lines G1-0, G1-1 and G1-2 constitute the first group of gate lines, the gate lines G3-0 (G1-2), G3-1 and G3-2 constitute the second group of gate lines, and other gate lines are grouped in the same way. When displaying, firstly, scanning the first group of gate lines G1-0, G1-1 and G1-2 to display the first row of pixel units. That is, the sub-subpixels 110*a*-110*b*, 120*a*-120*b*, 130*a*-130*b* of the subpixels 110, 120, 130 in the first row of pixel units are respectively controlled according to the timing signals. Then, the second group of gate lines G2-0, G2-1 and G2-2 are scanned to display the pixel units in the second row. Then, the third group of gate lines G3-0 (G1-2), G3-1 and G3-2 are scanned to display the pixel units in the third row. Then, the fourth group of gate lines G4-0 (G2-2), G4-1 and G4-2 are scanned to display the pixel units in the fourth row. In this way, scanning is carried out group by group until the last group of gate lines, thereby completing the display of all rows of the display panel, i.e., completing the display of one frame of image.

It should be understood that according to this embodiment, it is also possible to consider every two adjacent gate lines as a group, and scan the gate lines group by group to realize the display of the whole display panel, wherein the second one of the two gate lines is scanned for one time. For example, gate lines G1-0 and G1-1 are taken as the first group for scanning; gate lines G1-1 and G1-2 are taken as the second group for scanning; gate lines G1-2 (G3-0) and G3-1 are taken as the third group for scanning; the remaining gate lines are taken into groups and scanned in the same way. In this case, when displaying, the first group of gate lines G1-0 and G1-1 are scanned, firstly, to display sub-subpixels 110*a*, 120*a* and 130*a*. Then, the second group of gate lines G1-1 and G1-2 are scanned to display sub-subpixels 110*b*, 120*b* and 130*b*. Then, the third group of gate lines G1-2 (G3-0) and G3-1 are scanned to display the third row of sub-subpixels. Then, the fourth group of gate lines G3-1 and G3-2 are scanned to display the fourth row of sub-subpixels. In this way, scanning is carried out group by group until the last group of gate lines, thereby completing the display of all rows of the display panel, i.e., completing the display of one frame of image.

In this embodiment, for example, for the first subpixel 110, there are the following four different display modes. The first display mode: the first sub-subpixel 110*a* and the second sub-subpixel 110*b* both are not turned on, then the gray scale displayed by the first subpixel 110 is represented by R21. The second display mode: the first sub-subpixel 110*a* is not turned on and the second sub-subpixel 110*b* is turned on, then the gray scale displayed by the first subpixel 110 is represented by R22. The third display mode: the first sub-subpixel 110*a* is turned on and the second sub-subpixel 110*b* is not turned on, then the gray scale displayed by the first subpixel 110 is represented by R23. The fourth display mode: the first sub-subpixel 110*a* and the second sub-subpixel 110*b* are both turned on, then the gray scale displayed by the first subpixel 110 is represented by R24. Thus, four different display gray scales R21-R24 are realized in each subpixel. For example, in an RGB display system, each pixel unit 100 includes three different subpixels 110, 120, and 130 of R, and B. By adopting the above pixel layout, each pixel unit provides a display of 4*4*4=64 colors.

Figure 3:
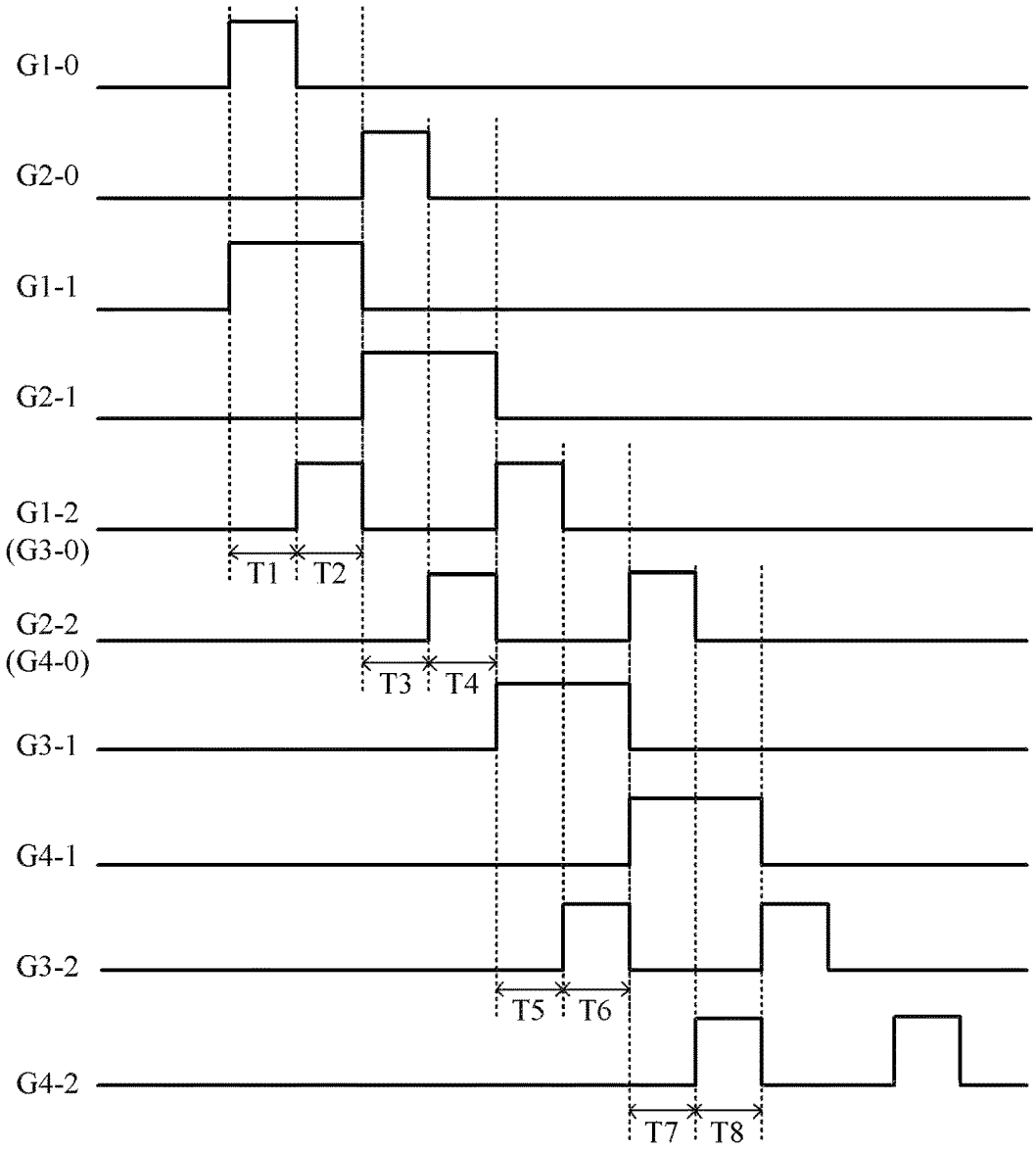
FIG. 3 is a timing diagram of signals for driving the pixel unit shown in FIG. 2.

FIG. 3 schematically shows a timing signal for driving the pixel unit shown in FIG. 2. In the timing diagram shown in FIG. 3, in the T1 stage and T2 stage, the driving of the pixel units of the first odd-numbered row (the first row) is completed; in the T3 stage and T4 stage, the driving of the pixel units of the first even-numbered row (the second row) is completed; in the T5 stage and T6 stage, the driving of the subpixels of the second odd-numbered row (the third row) is completed; and in the T7 stage and T8 stage, the driving of the subpixels of the second even-numbered row (the fourth row) is completed. In the subsequent time periods, the subpixels of all rows are driven in turn.

Next, with reference to FIG. 3, the driving mode of the pixel units in the first row in the display panel of this embodiment will be schematically described. In the T1 stage, the first gate line G1-0 and the second gate line G1-1 are both at a high level (i.e., "1") and the third gate line G1-2 is at a low level (i.e., "0"), then the first data line S1 and the first sub-subpixel 110*a* are conducted there-between. In the T2 stage, the second gate line G1-1 and the third gate line G1-2 both are at high level and the first gate line G1-0 is at low level, then the first data line S1 and the second sub-subpixel 110*b* are conducted there-between. By setting the driving signals (i.e., high level or low level) applied to the first gate line G1-0 and the second gate line G1-1 in the T1 stage and T2 stage, four different display gray scales are realized in each subpixel, as described above.

Figure 4:
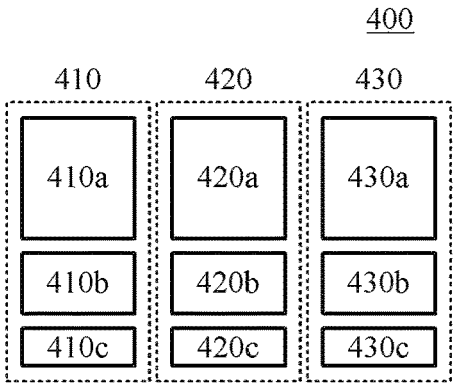
FIG. 4 is a schematic diagram of a pixel unit of a display panel according to another embodiment of the present disclosure.

FIG. 4 schematically illustrates the layout of pixel units of a display panel according to another embodiment of the present disclosure. In this embodiment, the display panel may include a plurality of pixel units 400 (only one of which is schematically shown in FIG. 4), and each pixel unit 400 may include three subpixels, namely, a first subpixel 410, a second subpixel 420 and a third subpixel 430. Taking the RBG tricolor display system as an example, the first subpixel 410 may be a red subpixel, the second subpixel 420 may be a green subpixel, and the third subpixel 430 may be a blue subpixel.

Unlike the embodiments shown in FIGS. 1-3, in the embodiment of FIG. 4, each subpixel can be divided into three sub-subpixels. For example, the first subpixel 410 may include a first sub-subpixel 410*a*, a second sub-subpixel 410*b*, and a third sub-subpixel 410*c*; the second subpixel 420 may include a first sub-subpixel 420*a*, a second sub-subpixel 420*b*, and a third sub-subpixel 420*c*; and the third subpixel 430 may include a first sub-subpixel 430*a*, a second sub-subpixel 430*b*, and a third sub-subpixel 430*c*.

In this embodiment, each subpixel can be divided into three sub-subpixels according to the preset area ratio. For example, the area ratio of the first sub-subpixel to the second sub-subpixel to the third sub-subpixel of each subpixel may be 4:2:1. For example, taking the first subpixel 410 of the pixel unit shown in FIG. 4 as an example, the area ratio of the first sub-subpixel 410*a* to the second sub-subpixel 410*b* to the third sub-subpixel 410*c* is 4:2:1.

Figure 5:
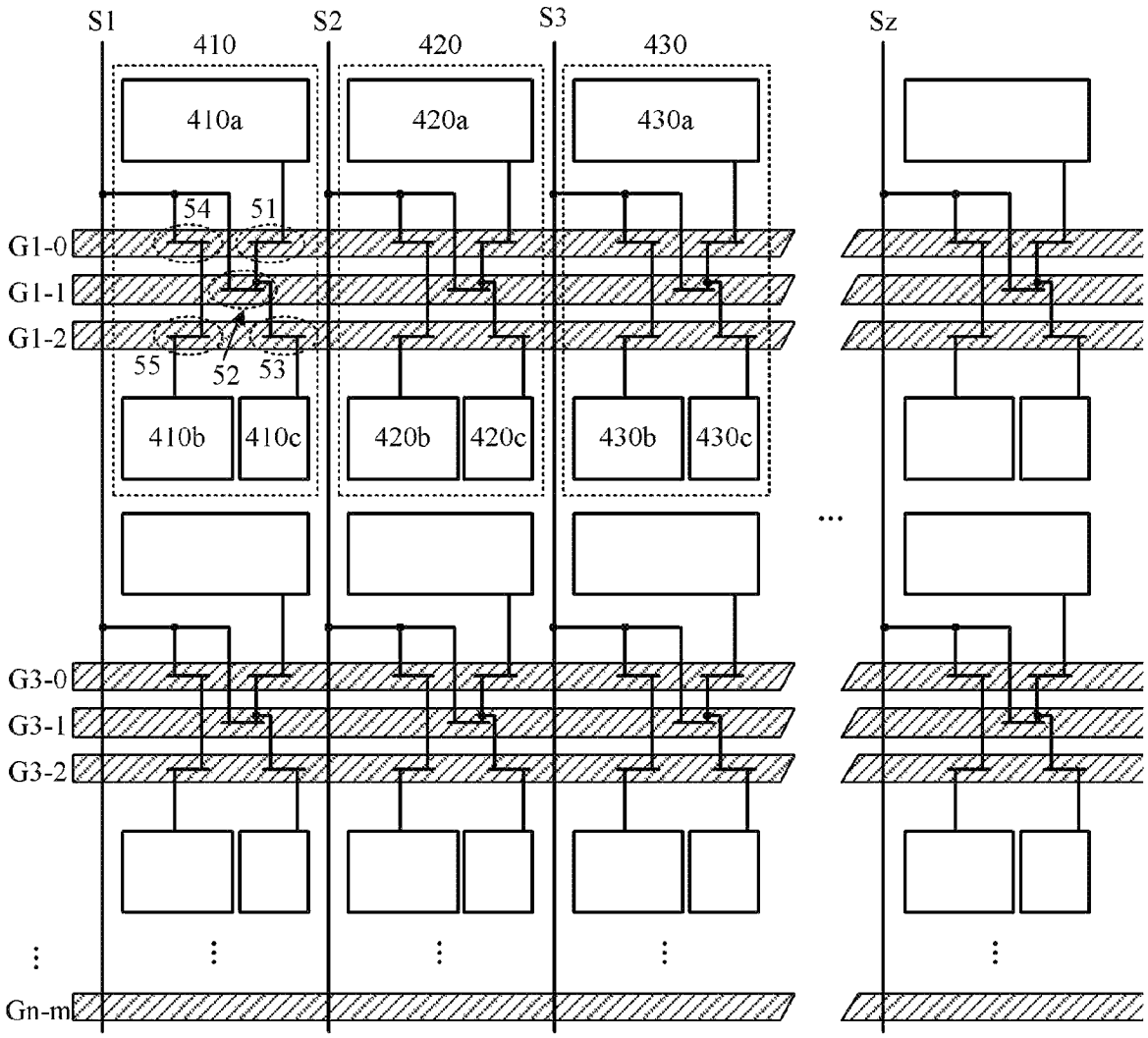
FIG. 5 is a wiring diagram for the pixel unit shown in FIG. 4.

FIG. 5 schematically shows a wiring diagram of a pixel unit for the display panel shown in FIG. 4. Similar to the circuit diagram of the previous embodiment shown in FIG. 2, a plurality of pixel units 400 are arranged in an array, each pixel unit includes a plurality of subpixels, and each subpixel includes three sub-subpixels. The display panel also includes a plurality of data lines and a plurality of groups of gate lines, each group of gate lines includes at least three gate lines, and the data lines S1-Sz are staggered with the gate lines G1-0 to GN-M. Taking the pixel units of the display panel shown in FIG. 4 as an example, each row of pixel units (or subpixels) is configured to be controlled by a corresponding group of gate lines, and each column of subpixels is configured to be connected to a corresponding data line and configured such that each sub-subpixel receives a data signal from this data line under the control of each group of gate lines. FIG. 5 shows only z data lines S1, S2, S3, . . . , Sz, pixel units in odd-numbered rows, and gate lines G1-0, G1-1, G1-2, G3-0, G3-1, G3-2, . . . , Gn-m included in the odd-numbered groups of gate lines corresponding to the pixel units in the odd-numbered rows. Here, n is a positive odd number greater than 1, and m is an integer between 0 and 2.

According to this embodiment, the pixel units in each row correspond to a group of gate lines, and each group of gate lines includes at least three gate lines. For example, the pixel units 400 in the first odd-numbered row (or the subpixels included in the pixel units) correspond to the first group of gate lines. The first group of gate lines includes three gate lines, such as a first gate line G1-0, a second gate line G1-1 and a third gate line G1-2. The pixel units 400 in the second odd-numbered row correspond to the third group of gate lines. The third group of gate lines includes three gate lines, such as a third gate line G3-0, a fourth gate line G3-1 and a fifth gate line G3-2. Similarly, pixel units in each even-numbered row correspond to a group of gate lines including at least three gate lines. Pixel units in even-numbered rows and their corresponding groups of gate lines are not shown here, for example, pixel units in the first even-numbered row (the second row) and their corresponding second group of gate lines, and pixel units in the second even-numbered row (the fourth row) and their corresponding fourth group of gate lines are not shown here.

In this embodiment, two switching elements jointly control one sub-subpixel, and each switching element is controlled by a corresponding gate line. For example, the first sub-subpixel 410*a* is controlled by a combination of first and second switching elements 51 and 52, the second sub-subpixel 410*b* is controlled by a combination of fourth and fifth switching elements 54 and 55, and the third sub-subpixel 410*c* is controlled by a combination of second and third switching elements 52 and 53.

In this embodiment, each column of subpixels is connected to a corresponding data line and receives data signals from the corresponding data line; each data line is connected to sub-subpixels of each subpixel through a corresponding switching element. The first subpixel 410 of the first row of pixel units shown in FIG. 5 is taken as an example for illustrative explanation. The first subpixel 410 may include a first sub-subpixel 410*a*, a second sub-subpixel 410*b*, and a third sub-subpixel 410*c*. The first sub-subpixel 410*a* is connected to the first data line 51 through the first switching element 51 and the second switching element 52. The second sub-subpixel 410*b* is connected to the first data line 51 through the fifth switching element 55 and the fourth switching element 54. The third sub-subpixel 410*c* is connected to the first data line S1 through the third switching element 53 and the second switching element 52. In the embodiment of the present disclosure, each pixel unit includes three subpixels, so each column of pixel units corresponds to three data lines, and each of the three data lines is connected to three columns of subpixels in this column of pixel units.

In some examples of this embodiment, the switching elements (such as the switching elements 21-23 in FIG. 2 and the switching elements 51-55 in FIG. 5) may be thin film transistors or any other suitable switching elements.

For example, the switching elements 51-55 may be thin film transistors. The first switching element 51 may be a thin film transistor TFT1. The first sub-subpixel 410*a* is connected to one of the source electrode and drain electrode of the thin film transistor TFT1, and the gate electrode of the thin film transistor TFT1 is connected to the first gate line G1-0. And, the second switching element 52 may be a thin film transistor TFT2, the other one of the source electrode and drain electrode of the thin film transistor TFT1 is connected to one of the source electrode and drain electrode of the thin film transistor TFT2, the gate electrode of the thin film transistor TFT2 is connected to the second gate line G1-1, and the other one of the source electrode and drain electrode of the thin film transistor TFT2 is connected to the data line S1. The third switching element 53 may be a thin film transistor TFT3, one of the source electrode and drain electrode of the thin film transistor TFT2 is also connected to one of the source electrode and drain electrode of the thin film transistor TFT3, the gate electrode of the thin film transistor TFT3 is connected to the third gate line G1-1, and the other one of the source electrode and drain electrode of the thin film transistor TFT3 is connected to the third sub-subpixel 410*c*. The fourth switching element 54 may be a thin film transistor TFT4, and the fifth switching element 54 may be a thin film transistor TFT5. The second sub-subpixel 410*b* is connected to one of the source electrode and drain electrode of the thin film transistor TFT5, the gate electrode of the thin film transistor TFT5 is connected to the third gate line G1-2, the other one of the source electrode and drain electrode of the thin film transistor TFT5 is connected to one of the source electrode and drain electrode of the thin film transistor TFT4, the gate electrode of the thin film transistor TFT4 is connected to the first gate line G1-0, and the other one of the source electrode and drain electrode of the thin film transistor TFT4 is connected to the data line S1.

In this embodiment, two groups of gate lines corresponding to pixel units (or subpixels) in two adjacent odd-numbered rows share one gate line, and two groups of gate lines corresponding to pixel units (or subpixels) in two adjacent even-numbered rows share one gate line. Taking the situation shown in FIG. 5 as an example, a plurality of pixel units are arranged in an array and divided into odd-numbered rows of pixel units (or subpixels) and even-numbered rows of pixel units (or subpixels). The odd-numbered rows of pixel units correspond to odd-numbered groups of gate lines, and the even-numbered rows of pixel units correspond to even-numbered groups of gate lines. Therefore, two adjacent odd-numbered groups of gate lines share one gate line, and two adjacent even-numbered groups of gate lines share one gate line. For example, the first group of gate lines corresponding to pixel units 400 in the first odd-numbered row (the first row) and the third group of gate lines corresponding to pixel units in the second odd-numbered row (the third row) share one gate line, that is, the third gate line G1-2 (G3-0). Similarly, the second group of gate lines corresponding to pixel units in the first even-numbered row (the second row) and the fourth group of gate lines corresponding to pixel units in the second even-numbered row (the fourth row) share one gate line.

Next, the displaying process of the display panel of this embodiment will be schematically described with reference to FIG. 5. When displaying, the first group of gate lines G1-0, G1-1 and G1-2 are scanned firstly to display the sub-subpixels of the first row of pixel units. That is, the sub-subpixels 410a-410c, 420a-420c, and 430a-430c of the subpixels 410, 420, and 430 are controlled according to time sequence, respectively. Then, the second group of gate lines G2-0, G2-1, and G2-2 are scanned to display the sub-subpixels of the second row of pixel units. Then, the third group of gate lines G3-0 (G1-2), G3-1 and G3-2 are scanned to display the sub-subpixels of the pixel units in the third row. Then, the fourth group of gate lines G4-0 (G2-2), G4-1 and G4-2 are scanned to display the sub-subpixels of the pixel units in the fourth row. In this way, scanning is carried out group by group until the last group of gate lines, thereby completing the display of all rows of the display panel, i.e., completing the display of one frame of image.

In this embodiment, each row of pixel units (or subpixels) is connected to a group of gate lines, and each group of gate lines includes three gate lines. Sub-subpixels in each subpixel are respectively turned on or off to provide different display gray scales. Compared with the embodiment shown in FIG. 2, the embodiment of FIG. 5 controls the on and off of three different sub-subpixels without increasing data lines and gate lines. With this design, the number of the controllable sub-subpixels is increased without increasing the data lines and the gate lines. In addition, compared with the conventional design in which each gate line controls a corresponding sub-subpixel, the number of the gate lines is reduced.

In this embodiment, there are the following eight different display modes for the first subpixel 410. The first display mode: none of the first sub-subpixel 410a, the second sub-subpixel 410b and the third sub-subpixel 410c is turned on, then the gray scale displayed by the first subpixel 410 is represented by R41. The second display mode: the first sub-subpixel 410a and the second sub-subpixel 410b are not turned on, while the third sub-subpixel 410c is turned on, then the gray scale displayed by the first subpixel 410 is represented by R42. The third display mode: the first sub-subpixel 410a and the third sub-subpixel 410c are not turned on, while the second sub-subpixel 410b is turned on, then the gray scale displayed by the first subpixel 410 is represented by R43. Since the brightness or darkness of subpixel display (i.e., gray scale) is related to the area of sub-subpixels turned on in the subpixels, based on the above three display modes, the following other five display gray scales can be obtained. The fourth display mode: the first sub-subpixel 410a is not turned on, while the second sub-subpixel 410b and the third sub-subpixel 410c are turned on, then the gray scale displayed by the first subpixel 410 is represented by R44. The fifth display mode: the first sub-subpixel 410a is turned on, while the second sub-subpixel 410b and the third sub-subpixel 410c are not turned on, then the gray scale displayed by the first subpixel 410 is represented by R45. In the sixth display mode, the first sub-subpixel 410a and the third sub-subpixel 410c are turned on, while the second sub-subpixel 410b is not turned on, then the gray scale displayed by the first subpixel 410 is represented by R46. The seventh display mode: the first sub-subpixel 410a and the second sub-subpixel 410b are turned on, while the third sub-subpixel 410c is not turned on, then the gray scale displayed by the first subpixel 410 is represented by R47. The eighth display mode: the first sub-subpixel 410a, the second sub-subpixel 410b and the third sub-subpixel 410c are all turned on, then the gray scale displayed by the first subpixel 410 is represented by R48. Thus, eight different display gray scales R41-R48 are realized in each subpixel.

In this embodiment, for a display system with three primary colors such as RGB, the first subpixel 410, the second subpixel 420 and the third subpixel 430 of each pixel unit 400 are red, green and blue subpixels, respectively. In this case, a display of 8×8×8=512 colors can be provided. This increases the number of the gray scales and the colors as displayed. Therefore, the displayed colors of the display panel is richer, and the user experience effect is further improved.

Figure 6:
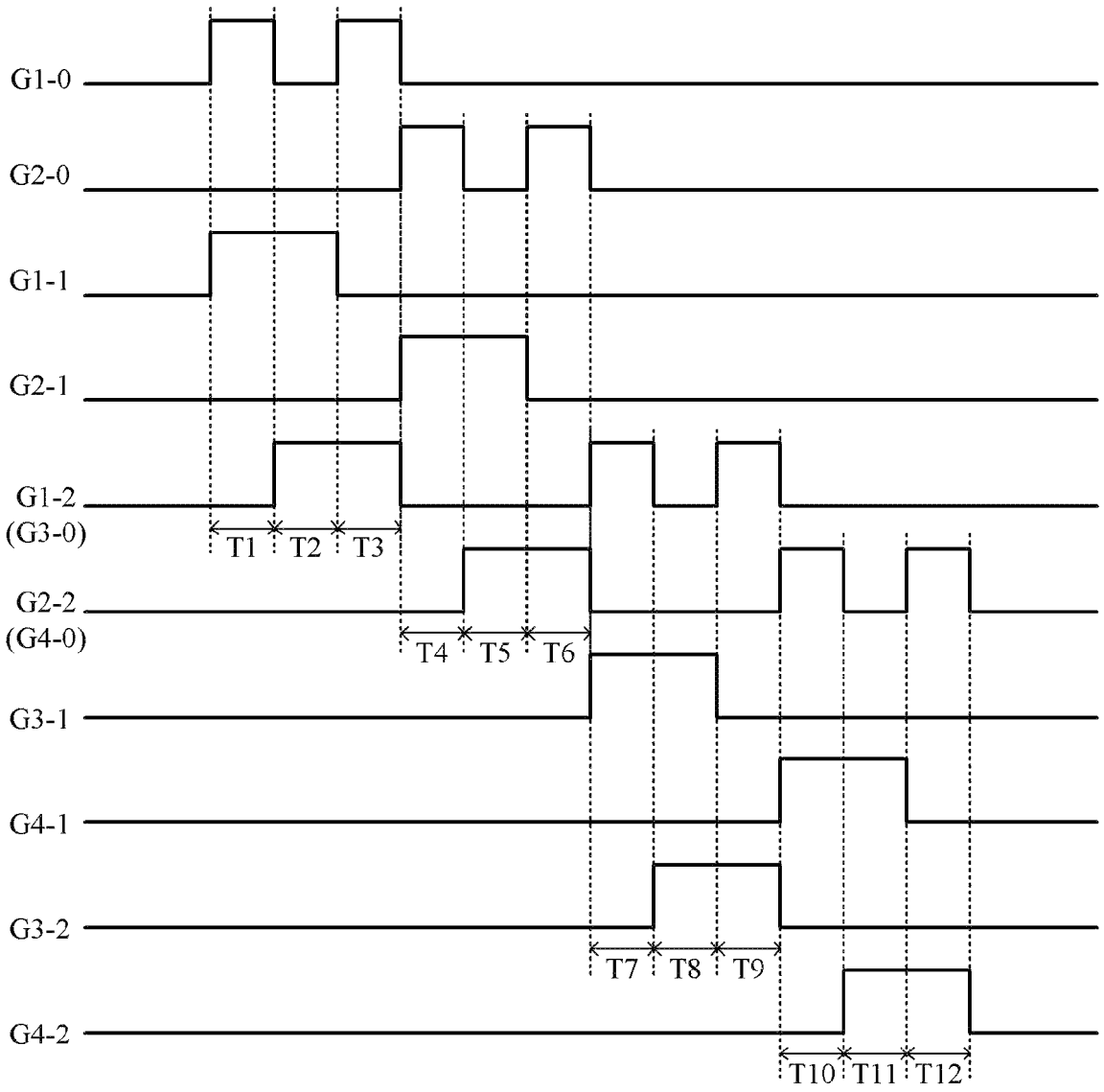
FIG. 6 is a timing diagram of signals for driving the pixel unit shown in FIG. 4.

FIG. 6 schematically shows a timing diagram of signals for driving the pixel unit shown in FIG. 5. In the timing diagram shown in FIG. 6, the driving of the first row of subpixels is completed in T1 stage, T2 stage and T3 stage; in T4 stage, T5 stage and T6 stage, the driving of the second row of subpixels is completed; in T7 stage, T8 stage and T9 stage, the driving of the third row of subpixels is completed; and in T10 stage, T11 stage and T12 stage, the driving of the fourth row of subpixels is completed. By analogy, driving signals are applied to the corresponding gate lines to complete the driving of subpixels of all rows.

Next, the driving mode of the first row of subpixels will be schematically described with reference to FIG. 6, so that those skilled in the art can understand the driving modes of other rows of subpixels. In the T1 stage, the first gate line G1-0 and the second gate line G1-1 are both at high level and the third gate line G1-2 is at low level, then the first data line S1 and the first sub-subpixel 410a are conducted there-between. In the T2 stage, the second gate line G1-1 and the third gate line G1-2 are both at high level and the first gate line G1-0 is at low level, then the first data line S1 and the third sub-subpixel 410c are conducted there-between. In the T3 stage, the first gate line G1-0 and the third gate line G1-2 are both at high level and the second gate line G1-1 is at low level, then the first data line S1 and the second sub-subpixel 410b are conducted there-between. By setting the driving signals (i.e., high level or low level) applied to the gate lines G1-0, G1-1, and G1-2 in the T1 stage, T2 stage, and T3 stage, eight different display gray scales are realized in each subpixel, as described above.

It should be understood that although this embodiment has been described above by taking the scanning mode of progressive scanning as an example, scanning modes such as interlaced scanning are also possible, that is, the scanning of pixel units (or subpixels) in odd-numbered rows can be carried out separately from the scanning of pixel units (or subpixels) in even-numbered rows.

It should be understood that in some examples of this embodiment, the grouping modes of the gate lines connected to each row of pixel units (or subpixels) may be different when different scanning modes are adopted. For example, the pixel units 400 in the first row (or the subpixels included in the subpixel units) correspond to the first group of gate lines. The first group of gate lines includes three gate lines, such as a first gate line G1-0, a second gate line G1-1 and a third gate line G1-2. The pixel units 400 in the second row (or the subpixels included in the pixel units) correspond to the second group of gate lines. The second group of gate lines includes three gate lines, such as a third gate line G2-0, a fourth gate line G2-1 and a fifth gate line G2-2. The gate lines corresponding to the pixel units 400 in other rows (or the subpixels included in the pixel units) are set in the same way. The way in which each subpixel (sub-subpixel) is connected to the gate line and the data line is similar to the foregoing description of this embodiment, and will not be repeated here. In this case, two adjacent groups of gate lines share one gate line, that is, two groups of gate lines corresponding to two adjacent rows of subpixels share one gate line, for example, the first group of gate lines and the second group of gate lines share one gate line, that is, the third gate line G1-2 (G2-0). Accordingly, when displaying, the first group, the second group and so on can be scanned according to the scanning timing sequence, until the last group of gate lines, thus completing the first row, the second row and so on, until the last row of pixel units is displayed.

In this embodiment, the RGB tricolor display system is described as an example. However, it should be noted that the display panel according to the embodiment of the present disclosure can be used for display systems of more primary colors such as CMYK.

It should be noted that the circuit connection relationship between the three sub-subpixels and the gate lines in this embodiment is not limited to the relationship shown in FIGS. 4-6. For example, the positions of the three sub-subpixels can be interchanged.

In some examples of this embodiment, the three sub-subpixels in each subpixel have the same primary color. For example, taking the pixel unit shown in FIG. 5 as an example, the first subpixel 410 is an R subpixel, the second subpixel 420 is a G subpixel, and the third subpixel 430 is a B subpixel. In this case, the first sub-subpixel 410*a*, the second sub-subpixel 410*b* and the third sub-subpixel 410*c* of the first subpixel 410 are all R subpixels; The first sub-subpixel 420*a*, the second sub-subpixel 420*b* and the third sub-subpixel 420*c* of the second subpixel 420 are all G subpixels, and the first sub-subpixel 430*a*, the second sub-subpixel 430*b* and the third sub-subpixel 430*c* of the third subpixel 430 are all B subpixels.

In some examples of this embodiment, one of the three sub-subpixels in each subpixel is a white sub-subpixel. In some embodiments, the sub-subpixel with the smallest area among the three sub-subpixels is a white sub-subpixel. For example, in the embodiment shown in FIG. 5, the third sub-subpixel 410*c* of the first subpixel 410, the third sub-subpixel 420*c* of the second subpixel 420, and the third sub-subpixel 430*c* of the third subpixel 430 are white sub-subpixels.

In some examples of this embodiment, in each subpixel, the above-mentioned white sub-subpixel is a total reflection sub-subpixel, and other sub-subpixels are transmission sub-subpixels. When the display panel is operated at a low refresh rate of, for example, 1 HZ, the rear backlight is cut off, and the transmission part of the display panel (i.e., the sub-subpixels except the white sub-subpixel in each sub-pixel) does not perform display. At this time, due to the presence of external ambient light, the reflection part of the display panel (i.e., the total reflection sub-subpixels) can perform display by reflecting the ambient light. Therefore, when the display panel works at a low refresh rate, the reflectivity is improved, and hence the display brightness of the display panel at a low refresh rate is improved.

The display panel described in the embodiments of the present disclosure can also be applied to the case where each row of subpixels corresponds to more than three gate lines. In this case, the number of the sub-subpixels that can be individually controlled will be more than three.

In the embodiment of the present disclosure, the term "turned-on/on" is not limited to charging or energizing the self-luminous pixel unit, and any means that can make the pixel unit emit light, such as adjusting the direction of liquid crystal to make the pixel unit emit light, should be included in the scope of the term "turned-on/on". Accordingly, "turned-off/off" means the opposite of "turned-on/on", that is, the sub-subpixel of the pixel unit is changed from a luminous state to a non-luminous state.

Based on the same inventive concept, the embodiment of the present disclosure also provides a display device, which includes the display panel provided by the embodiment of the present disclosure. The display device can be any product or component with display function, such as a mobile phone, a tablet computer, a television, a display, a notebook computer, a digital photo frame, a navigator, etc. The implementation of the display device can refer to the above embodiments of the display panel, and the repeated contents will be omitted here.

It should be understood that in addition to the display panel described in the above embodiments, the display device provided by the embodiments of the present disclosure may also include a source driver, a gate driver, and a timing controller. For example, the output terminal of the source driver is connected to the data line of the display panel and is configured to provide a data signal to the data line; this data signal is input to the subpixel or sub-subpixel connected to the data line. For example, the gate driver is connected to the gate lines of the display panel and is configured to provide scanning signals to the gate lines; when the gate line receives the scanning signal, the switching element of a certain row of subpixels connected with the gate line is turned on, so that the data signal can be received. For example, the timing controller is connected to the source driver and the gate driver; the timing controller generates a gate control signal and a source control signal; the source control signal is output to the source driver and the gate control signal is output to the gate driver, thereby controlling the operation of the source driver and the gate driver.

Embodiments of the present disclosure provide a display panel and a display device including the same. According to the technical solutions of the present disclosure, each pixel unit includes a plurality of subpixels, each subpixel includes at least two sub-subpixels, each row of subpixels is configured to be controlled by a corresponding group of gate lines, and each column of subpixels is configured such that the at least two sub-subpixels receive data signals from a corresponding data line under the control of each group of gate lines. Therefore, compared with the conventional design that each gate line controls a corresponding sub-subpixel, the gray scale and color number of the display panel are increased under the condition that the number of gate lines is reduced. In addition, when each subpixel includes at least three sub-subpixels, the sub-subpixel with the smallest area can be configured as a total reflection sub-subpixel (white sub-subpixel). With the design of the total reflection sub-subpixel, the display brightness of the screen is improved in the low refresh rate display mode, thus improving the user experience.

The above are merely specific embodiments of the present disclosure, but the protection scope of the present invention is not limited thereto. Any person skilled in the art can easily conceive of changes or substitutions within the technical scope disclosed in the present invention, which should be covered within the protection scope of the present invention. Therefore, the protection scope of the present invention should be subject to the protection scope of the claims.

The present application claims priority to Chinese patent application No. 201910412211.9, filed on May 17, 2019, the entire disclosure of which is incorporated herein by reference as part of the present application.

What is claimed is:

1. A display panel, comprising:

a plurality of data lines;

a plurality of groups of gate lines, wherein each of the plurality of groups of gate lines comprises at least three gate lines; and a plurality of pixel units, wherein the plurality of pixel units are arranged in an array, each of the plurality of pixel units comprises a plurality of subpixels, and each of the plurality of subpixels comprises at least two sub-subpixels, wherein each row of subpixels is configured to be controlled by a corresponding group of gate lines, and each column of subpixels is configured such that the at least two sub-subpixels receive a data signal from a corresponding data line under a control of each of the plurality of groups of gate lines, wherein for each of the plurality of subpixels, the display panel further comprises a plurality of switching elements; and in each of the plurality of subpixels, each of the at least two sub-subpixels is connected to a corresponding data line through two switching elements of the plurality of switching elements; and wherein each of the plurality of subpixels comprises a first sub-subpixel and a second sub-subpixel; each of the plurality of groups of gate lines comprises a first gate line, a second gate line and a third gate line; and the plurality of switching elements comprise a first switching element, a second switching element and a third switching element; and for each of the plurality of subpixels, the first sub-subpixel is connected to the first data line through the first switching element and the second switching element, and the second sub-subpixel is connected to the first data line through the third switching element and the second switching element.

2. The display panel according to claim 1, wherein two groups of gate lines corresponding to two adjacent rows of subpixels share one gate line.

3. The display panel according to claim 1, wherein the plurality of groups of gate lines comprise odd-numbered groups of gate lines corresponding to odd-numbered rows of pixel units and even-numbered groups of gate lines corresponding to even-numbered rows of pixel units, and wherein two adjacent odd-numbered gate lines share one gate line, and two adjacent even-numbered gate lines share one gate line.

4. The display panel according to claim 1, wherein an on-off of each of the plurality of switching elements is controlled by a corresponding gate line.

5. The display panel according to claim 4, wherein the switching element is a thin film transistor.

6. The display panel according to claim 1, wherein the first gate line controls an on-off of the first switching element, the second gate line controls an on-off of the second switching element, and the third gate line controls an on-off of the third switching element.

7. The display panel according to claim 1 wherein a ratio of an area of the first sub-subpixel to an area of the second sub-subpixel is 2:1.

8. The display panel according to claim 1, wherein the at least two sub-subpixels further comprise a third sub-subpixel in addition to the first and second sub-subpixels; and the plurality of switching elements further comprise a fourth switching element and a fifth switching element in addition to the first, second and third switching elements.

9. The display panel according to claim 8, wherein the first gate line controls an on-off of the first switching element and the fourth switching element, the second gate line controls an on-off of the second switching element, and the third gate line controls an on-off of the third switching element and the fifth switching element.

10. The display panel according to claim 8, wherein for each of the plurality of subpixels, the first sub-subpixel is connected to the first data line through the first switching element and the second switching element, the second sub-subpixel is connected to the first data line through the fifth switching element and the fourth switching element rather than through the third switching element and the second switching element, and the third sub-subpixel is connected to the first data line through the third switching element and the second switching element.

11. The display panel according to claim 8, wherein a ratio of an area of the first sub-subpixel to an area of the second sub-subpixel to an area of the third sub-subpixel is 4:2:1.

12. The display panel according to claim 8, wherein the first sub-subpixel, the second sub-subpixel and the third sub-subpixel of each of the plurality of subpixels have a same primary color.

13. The display panel according to claim 8, wherein the third sub-subpixel of each of the plurality of subpixels is a white sub-subpixel.

14. The display panel according to claim 13, wherein the white sub-subpixel is a total reflection sub-subpixel.

15. A display device, comprising the display panel according to claim 1.

16. The display device according to claim 15, wherein two groups of gate lines corresponding to two adjacent rows of subpixels share one gate line.

17. The display device according to claim 15, wherein the plurality of groups of gate lines comprise odd-numbered groups of gate lines corresponding to odd-numbered rows of pixel units and even-numbered groups of gate lines corresponding to even-numbered rows of pixel units, and wherein two adjacent odd-numbered gate lines share one gate line, and two adjacent even-numbered gate lines share one gate line.

* * * * *